US012473827B2

(12) United States Patent
Jamison et al.

(10) Patent No.: US 12,473,827 B2
(45) Date of Patent: Nov. 18, 2025

(54) ANALYZING DRILL CUTTINGS USING ACOUSTIC ANALYSIS

(71) Applicant: Halliburton Energy Services, Inc., Houston, TX (US)

(72) Inventors: Dale E. Jamison, Houston, TX (US); Andrew Vos, Houston, TX (US); Brian Alan Evans, Houston, TX (US); Daniel Joshua Stark, Carrollton, TX (US); Denise Nicole Benoit, Houston, TX (US); Mateusz Michal Dyngosz, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 553 days.

(21) Appl. No.: 17/993,324

(22) Filed: Nov. 23, 2022

(65) Prior Publication Data

US 2024/0167380 A1 May 23, 2024

(51) Int. Cl.
*E21B 49/00* (2006.01)
*E21B 21/06* (2006.01)
(Continued)

(52) U.S. Cl.
CPC ..... *E21B 49/005* (2013.01); *E21B 47/0025* (2020.05); *E21B 47/0224* (2020.05);
(Continued)

(58) Field of Classification Search
CPC .... E21B 49/00; E21B 2200/22; E21B 49/003; E21B 21/065; E21B 2200/20;
(Continued)

(56) References Cited

U.S. PATENT DOCUMENTS

2005/0242003 A1* 11/2005 Scott ..... B01D 33/0315 210/388
2011/0114542 A1* 5/2011 Carr ..... B07B 1/42 209/369

(Continued)

FOREIGN PATENT DOCUMENTS

WO 2017040667 A1 3/2017
WO 2019236272 A1 12/2019

*Primary Examiner* — Kristina M Deherrera
*Assistant Examiner* — Truong D Phan
(74) *Attorney, Agent, or Firm* — Michael Jenney; Parker Justiss, P.C.

(57) ABSTRACT

Analyzing solid components in the return line of a borehole can be accomplished by implementing a bar or disc in the return line. As solid components pass by, they will generate an acoustic wave on impact. In another aspect, solid components can be directed to a shaker system where the solid components will impact a soundboard. The acoustic waves can be captured, such as by a microphone or transducer. The acoustic waves can be processed and transformed into acoustic data. A machine learning system can use previously trained models to determine the solid component parameters using the acoustic data. The parameters can include the size, shape, composition, density, softness, wettability, and other parameters of the solid components. These parameters can then be used as inputs to users or other borehole systems, such as a well site controller to improve drilling operations or to identify the need to implement corrective actions.

23 Claims, 10 Drawing Sheets

(51) Int. Cl.

| | |
|---|---|
| ***E21B 47/002*** | (2012.01) |
| ***E21B 47/0224*** | (2012.01) |
| ***E21B 47/085*** | (2012.01) |
| ***E21B 47/095*** | (2012.01) |
| ***E21B 47/107*** | (2012.01) |

(52) U.S. Cl.
CPC ..... *E21B 47/085* (2020.05); *E21B 47/095* (2020.05); *E21B 47/107* (2020.05); *E21B 21/065* (2013.01)

(58) Field of Classification Search
CPC ..... E21B 21/01; E21B 21/002; E21B 27/005; E21B 43/02; E21B 43/38; E21B 21/063; E21B 43/34; E21B 43/35; E21B 47/107; E21B 49/005; E21B 47/095; E21B 47/085; E21B 47/0224; E21B 47/0025; E21B 44/00; G01B 17/00
USPC ..... 73/152.04, 152.23, 152.31
See application file for complete search history.

(56) References Cited

U.S. PATENT DOCUMENTS

| | | | | |
|---|---|---|---|---|
| 2012/0279932 | A1* | 11/2012 | Pomerleau ..... | F26B 17/26 210/785 |
| 2014/0333754 | A1 | 11/2014 | Graves et al. | |
| 2015/0114714 | A1 | 4/2015 | Dahl et al. | |
| 2017/0089153 | A1 | 3/2017 | Teodorescu | |
| 2020/0363289 | A1 | 11/2020 | Shekhar et al. | |

* cited by examiner

ANALYZING DRILL CUTTINGS USING ACOUSTIC ANALYSIS

TECHNICAL FIELD

This application is directed, in general, to analyzing solid components in the return line from downhole a borehole and, more specifically, to using acoustic analysis on the solid components.

BACKGROUND

When developing a borehole, such as performing drilling operations, data can be collected from the drilling fluid removed from the borehole. The return line from the borehole can contain fluid as well as solid components. The solid components can be shavings from the drill bit, cuttings, or material added to the fluid being pumped downhole. Being able to determine characteristics of the solid components that return from downhole the borehole would be beneficial to the users and systems of the borehole.

SUMMARY

In one aspect, an apparatus is disclosed. In one embodiment, the apparatus includes (1) a shaker, configured to receive solid components from a return flow line of a borehole undergoing a drilling operation, and configured to restrict a flow of solid components, (2) a soundboard, configured to be struck by the solid components falling from the shaker, and (3) an acoustic device, configured to capture acoustic waves generated by the solid components striking the soundboard, and configured to communicate the acoustic waves to an acoustic data processor as acoustic data, and wherein the acoustic data processor is configured to determine one or more parameters of the solid components using the acoustic data.

In a second aspect, a system is disclosed. In one embodiment, the system includes (1) a return flow line from a borehole containing a fluid and solid components, wherein the borehole is undergoing a drilling operation, (2) a solid component collider, capable of generating acoustic waves when struck by the solid components moving through the return flow line, (3) an acoustic device, capable of collecting the acoustic waves and storing the acoustic waves as acoustic data, and (4) an acoustic processor, capable of filtering, transforming, and analyzing the acoustic data to generate one or more solid component parameters.

In a third aspect, a method is disclosed. In one embodiment, the method includes: (1) collecting acoustic data, using an acoustic device, from acoustic waves generated by solid components striking a solid component collider located at a surface portion of a return flow line of a borehole undergoing a drilling operation, wherein the solid components are located in the return flow line, (2) reducing signal noise in the acoustic data using a location acoustic model of the borehole and surface equipment, (3) applying one or more filters or transformations to the acoustic data to generate modified acoustic data, and (4) analyzing the modified acoustic data using one or more previously trained models to generate results, wherein the results include a determination of at least one solid component parameter.

BRIEF DESCRIPTION

Reference is now made to the following descriptions taken in conjunction with the accompanying drawings, in which.

DETAILED DESCRIPTION

Figure 1:
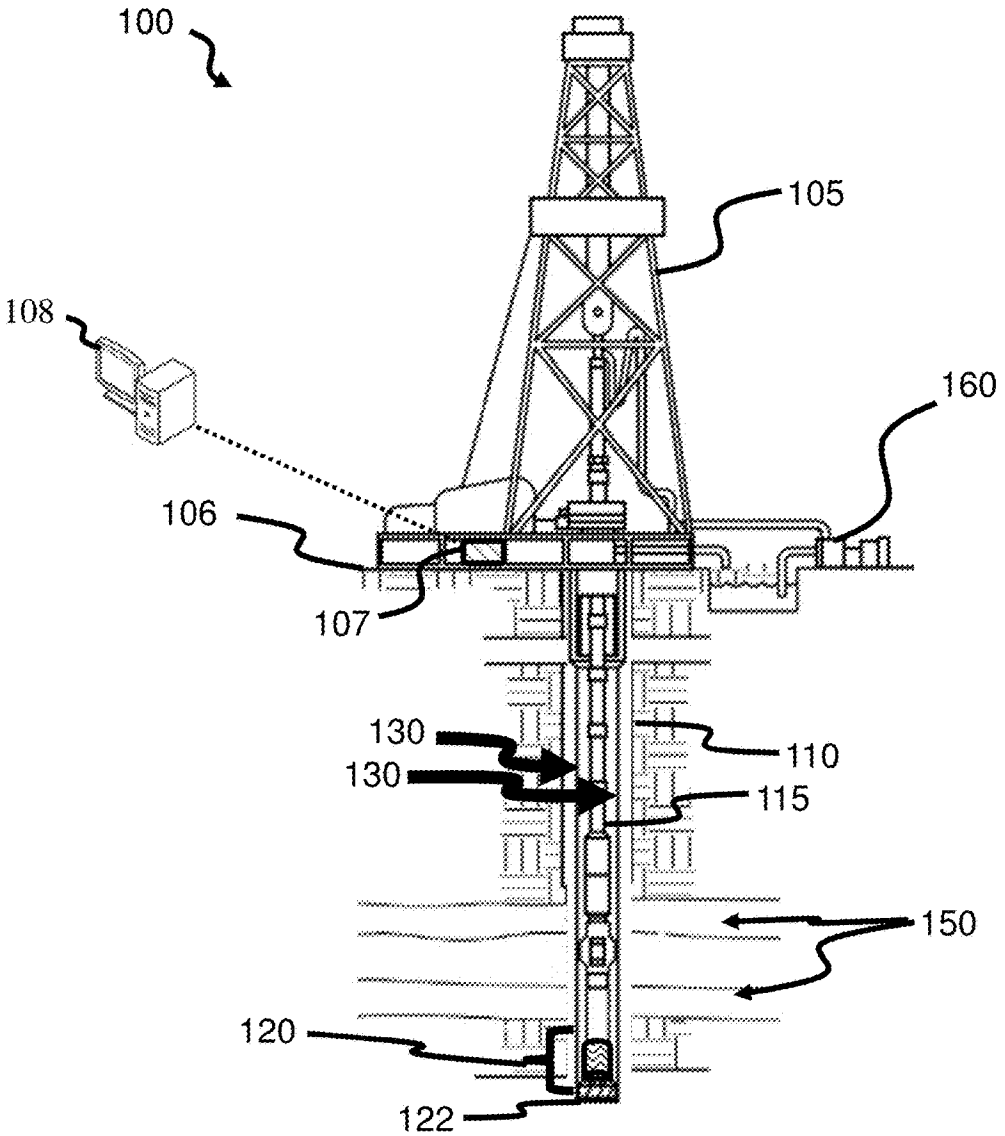
FIG. 1 is an illustration of a diagram of an example drilling system.

Developing a borehole, such as for scientific or hydrocarbon production purposes, can utilize data collected during operations, such as drilling operations. Other operations can be measuring while drilling (MWD), logging while drilling (LWD), seismic while drilling (SWD), and other types of borehole operations. Various types of sensors and tools can be utilized to collect the data, such as magnetic resonance sensors, resistivity sensors, acoustic sensors, nuclear sensors, temperature sensors, pressure sensors, seismic sensors, and other types of sensors. The data can be utilized by various borehole systems. For example, to adjust drilling parameters, to modify pumped borehole fluid, e.g., mud, adjust operations of a geo-steering system for a drilling assembly, or other uses by systems at the borehole.

One type of data collected can be an analyzation of the cuttings or other solid material that is transported to a surface location, for example, after a drilling operation where the cuttings are moved to the surface. The cuttings or other solids can be separated from other material retrieved from downhole a borehole, such as mud, water, brine, or downhole fluids such as hydrocarbons. Cuttings or other solids can be weighed to provide some mass data with respect to time. Other tests would need to be performed to determine cutting size, hardness, or wetted nature of the cuttings.

This disclosure presents apparatus, process, and methods to improve the analysis of retrieved solid components, such as cuttings, by determining more factors than are typically determined conventionally. The disclosure describes automating the process to reduce the time of performing the analysis to improve the responsiveness of a user or a system in responding to changing conditions downhole the borehole. The solid components can be removed at the shaker and collected in a cuttings box. At this point in the drilling operation, several factors regarding the solid components can be determined or estimated, such as the weight, mass, density, size, hardness, wetted nature, or other factors of the solid components. Being able to analyze the solid components at this point in the drilling process can improve the optimization of the drilling operation by enabling an early detection, prediction, or confirmation of drilling hazards encountered downhole.

For example, benefits of improving the analysis of solid components, (e.g., cuttings, drill bit shavings, casing shavings, injected tags, and other solid material), that are within the output flow of the borehole can be used to estimate the solid components volume flow rate in real-time or near real-time. The cuttings can be analyzed for size, such as to be able to detect a potential stuck pipe event, to determine a potential for caving, to model solid component transport, to tune drilling fluid graphics, to estimate bit wear utilizing a declining cutting size, or other analysis related to the cuttings size. The cuttings can be analyzed as to composition, such as the type of rock or salt being encountered downhole. The cuttings can be analyzed for chemical interactions occurring with the cuttings, for example, wettability. The solid components can be analyzed to assist in measuring the borehole volume by injecting uniquely identifiable components (e.g., tags) at the surface into the downhole flow (e.g., downhole fluid stream) and then detecting the acoustic signatures within the uphole flow (e.g., return flow line).

More specifically, the solid component analysis, e.g., the cuttings analysis, can determine parameters of the solid components such as mass, density, size, fluid invasion, type of formation material, or other parameters.

The analysis of the solid components can be used as inputs into the drilling operations, such as to model what is occurring downhole so that future drilling operation stages can be modified to accommodate the current environment downhole at the drilling location. For example, the drilling operations modifications can direct a pumping system to change the composition of drilling fluid pumped downhole or can direct a change in operation of the drilling assembly downhole.

The cuttings or other solids, at the shaker to cuttings box portion of the extraction process, can be positioned to fall onto a soundboard. The impact of the cuttings or other solids on the soundboard can be collected and recorded as sound wave parameters, i.e., acoustic data. The sound wave parameters can then be analyzed to determine or estimate the cutting size and softness. Softness can be interpreted as the wetted or softened nature of the cuttings. After a period of calibrating or training the system, the proposed disclosure can be used to collect the acoustic data and analyze the acoustic data without user intervention, e.g., enabling a passive analyzation process. The calibration can take into account ambient surface equipment noise or equipment vibrations inherent in the operating of the borehole and equipment.

In some aspects, a bar or disc can be located in the drilling fluid return line, for example, between the bell nipple (or diverter in offshore rigs) and the possum belly, rather than using a shaker and soundboard system. A microphone or transducer can be attached to the bar or disc to enable detection of impingement of the solid components within the flow stream (e.g., return flow line). This can allow an analyzation of the acoustic data from the solid component impingement for uniqueness or for unexpected changes. Existing solutions appear to result in yes or no detection without further information or detect impingement on the inside of the pipe without using a probe inserted into the flow stream.

In some aspects, acoustic data capture and analysis from cuttings or other solids dropping from shakers to cuttings boxes can enable real-time or near real-time data feed into geomechanics models, including forecasting borehole stability, potential for borehole collapse, or shale swelling issues in the open hole section of the borehole. In this disclosure, real-time is relative to the time taken for cuttings to move from the downhole location to the surface. In some aspects, the cuttings can take one to two hours to move this distance.

In some aspects, the analysis from the acoustic data can be performed by a machine learning or other type of artificial intelligence system. The machine learning system can account for signal to noise issues and analyze the current acoustic data using past collected acoustic data. The past acoustic data can be collected from a lab, or from the current or other borehole operations proximate or distant from the current borehole. In some aspects, the acoustic data analyzer or acoustic data processor using a machine learning system can be trained using solid components of poly-dispersed sizes, materials, or shapes. The solid components can be cuttings or cutting substitutes. The variety of interaction strengths between the solid components can be used to model the interactions of the cuttings with the surrounding environment. The interaction strengths can be of various types, such as chemical attraction, magnetic attraction, electric attraction, or other interaction types. The machine learning training can be updated in real-time or near real-time using the acoustic data captured during an active operation.

In some aspects, machine learning can be utilized to recognize new lithology being drilled. In some aspects, when tags are added to pumped borehole fluid, such as ceramic proppant or glass spheres (e.g., hollow or solid), the tags can be utilized to determine a cuttings transport efficiency parameter or a hole volume. The analysis of such tags can detect drilled solids sag in the borehole or to optimize fluid maintenance efficiency. In some aspects, tags with a range of density can be added simultaneously to determine fluid transport efficiency parameter prior to drilling a specific section or lithology layer.

In some aspects, an analysis of the acoustic data can be used to determine specific types of acoustic signatures, such as detecting a change in a size parameter, a shape parameter, or a density parameter of cuttings. The analysis can be utilized to validate drilling logs and alert rig personnel when cuttings samples should be captured and analyzed, thereby optimizing users' time as opposed to analyzing samples on a routine time schedule or by footage drilled.

In some aspects, iron filings (e.g., swarf) can be detected through an analysis of the acoustic data, which can be used to indicate casing wear. In some aspects, the acoustic data analysis can be utilized to determine the geological formation parameter or subterranean formation layer parameter currently being drilled, which can be utilized to provide real-time or near real-time depth alignment for the logs and the cutting collection services at the surface.

Turning now to the figures, FIG. 1 is an illustration of a diagram of an example drilling system 100, for example, a LWD system, a MWD system, a SWD system, a telemetry while drilling (TWD) system, injection well system, extraction well system, and other borehole systems. Drilling system 100 includes a derrick 105, a well site controller 107, and a computing system 108. Well site controller 107 includes a processor and a memory and is configured to direct operation of drilling system 100. Derrick 105 is located at a surface 106.

Extending below derrick 105 is a borehole 110 with downhole tools 120 at the end of a drill string 115. Downhole tools 120 can include various downhole tools, such as a formation tester or a BHA. Downhole tools 120 can include a resistivity tool or an ultra-deep resistivity tool. At the bottom of downhole tools 120 is a drilling bit 122. Other components of downhole tools 120 can be present, such as a local power supply (e.g., generators, batteries, or capacitors), telemetry systems, sensors, transceivers, and control systems. Borehole 110 is surrounded by subterranean formation 150.

Well site controller 107 or computing system 108 (e.g., surface controllers) which can be communicatively coupled to well site controller 107, can be utilized to communicate with downhole tools 120 (e.g., downhole controllers), such as sending and receiving acoustic data, telemetry, data, instructions, subterranean formation measurements, and other information. Computing system 108 can be proximate well site controller 107 or be a distance away, such as in a cloud environment, a data center, a lab, or a corporate office. Computing system 108 can be a laptop, smartphone, PDA, server, desktop computer, cloud computing system, other computing systems, or a combination thereof, that are operable to perform the processes described herein.

Well site operators, engineers, and other personnel can send and receive data, instructions, measurements, and other information by various conventional means, now known or later developed, with computing system 108 or well site controller 107. Well site controller 107 or computing system 108 can communicate with downhole tools 120 using conventional means, now known or later developed, to direct operations of downhole tools 120.

Casing 130 can act as barrier between subterranean formation 150 and the fluids and material internal to borehole 110, as well as drill string 115. The cuttings or other solids can be moved through a shaker 160 to collect acoustic data that can be analyzed by an acoustic data analyzer or an acoustic data processor. In some aspects, the acoustic data analyzer or acoustic data processor can utilize the acoustic data to generate a result (e.g., solid component parameters) of the borehole and surrounding subterranean formations.

In some aspects, the acoustic data analyzer can combine other data, such as known composition of the subterranean formation being drilled through, or the composition of the drilling mud or other fluids pumped downhole. The composition of the drilling mud or pumped fluids can be received from other systems of the borehole, for example, a well site controller, a drilling planning system, or a pump system. The composition of the subterranean formation can be received from sensors located downhole, from survey data collected from this or proximate boreholes, or from other geological databases proximate or distant from the borehole.

In some aspects, the acoustic data analyzer can communicate the collected data or the analysis to another system, such as computing system 108 or well site controller 107 where the acoustic data can be filtered and analyzed. In some aspects, computing system 108 can be the acoustic data analyzer and can receive the acoustic data. In some aspects, well site controller 107 can be the acoustic data analyzer and can receive the acoustic data. In some aspects, the acoustic data analyzer can be partially included with well site controller 107 and partially located with computing system 108. In some aspects, the acoustic data analyzer can be located in another system, for example, a data center, a lab, a corporate office, or another location.

Figure 2:
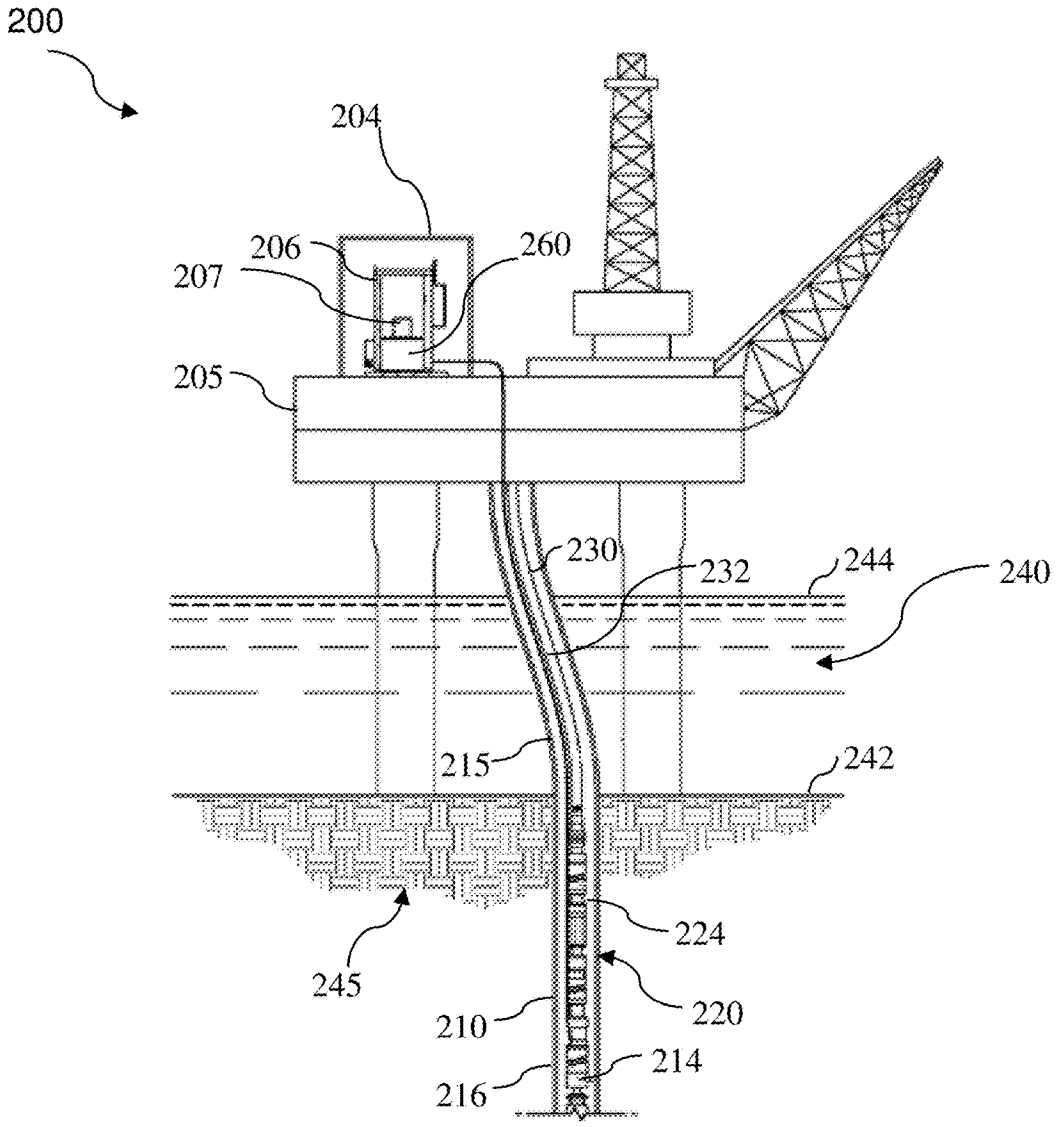
FIG. 2 is an illustration of a diagram of an example offshore system.

FIG. 2 is an illustration of a diagram of an example offshore system 200 with an electric submersible pump (ESP) assembly 220. ESP assembly 220 is placed downhole in a borehole 210 below a body of water 240, such as an ocean or sea. Borehole 210, protected by casing, screens, or other structures, is surrounded by subterranean formation 245. ESP assembly 220 can be used for onshore operations. ESP assembly 220 includes a well controller 207 (for example, to act as a speed and communications controller of ESP assembly 220), an ESP motor 214, and an ESP pump 224.

Well controller 207 is placed in a cabinet 206 inside a control room 204 on an offshore platform 205, such as an oil rig, above water surface 244. Well controller 207 is configured to adjust the operations of ESP motor 214 to improve well productivity. In the illustrated aspect, ESP motor 214 is a two-pole, three-phase squirrel cage induction motor that operates to turn ESP pump 224. ESP motor 214 is located near the bottom of ESP assembly 220, just above downhole sensors within borehole 210. A power/communication cable 230 extends from well controller 207 to ESP motor 214. A fluid pipe 232 fluidly couples equipment located on offshore platform 205 and ESP pump 224.

In some aspects, ESP pump 224 can be a horizontal surface pump, a progressive cavity pump, a subsurface compressor system, or an electric submersible progressive cavity pump. A motor seal section and intake section may extend between ESP motor 214 and ESP pump 224. A riser 215 separates ESP assembly 220 from water 240 until sub-surface 242 is encountered, and a casing 216 can separate borehole 210 from subterranean formation 245 at and below sub-surface 242. Perforations in casing 216 can allow the fluid of interest from subterranean formation 245 to enter borehole 210.

A shaker system 260 can be used to analyze cuttings retrieved from downhole. In some aspects, shaker system 260 can include an acoustic data analyzer or acoustic data processor to analyze the collected acoustic data. The analyzed data, e.g., results, can be communicated to one or more other systems, such as well controller 207. In some aspects, the acoustic data can be transmitted to another system, such as well controller 207. Well controller 207 can be the acoustic data analyzer or acoustic data processor, or can be an acoustic data analyzer controller. In some aspects, the acoustic data analyzer or acoustic data processor, or the acoustic data analyzer controller, can be partially in well controller 207, partially in another computing system, or various combinations thereof.

The results of the acoustic data analyzer, acoustic data processor, or acoustic data analyzer controller can be used to generate one or more characteristics or parameters of the cuttings, which can be used as inputs into the current or future drilling operation plans, such as directing operation of the drill bit, or be used to model subterranean formation 245. For example, the results can be utilized to determine one or more of a cuttings volume flow rate parameter, a cuttings size parameter, a cuttings mass parameter, a cutting softness parameter, a potential for a stuck drill pipe event parameter, a potential for a caving parameter, a cutting transport model parameter, a bit wear estimation parameter, a subterranean formation composition parameter, a chemical interaction parameter, a wettability of the subterranean formation composition parameter, or a hole volume measurement parameter.

FIG. 1 depicts onshore operations. Those skilled in the art will understand that the disclosure is equally well suited for use in offshore operations, such as shown in FIG. 2. FIGS. 1-2 depict specific borehole configurations, those skilled in the art will understand that the disclosure is equally well suited for use in boreholes having other orientations including vertical boreholes, horizontal boreholes, slanted boreholes, multilateral boreholes, and other borehole types.

Figure 3:
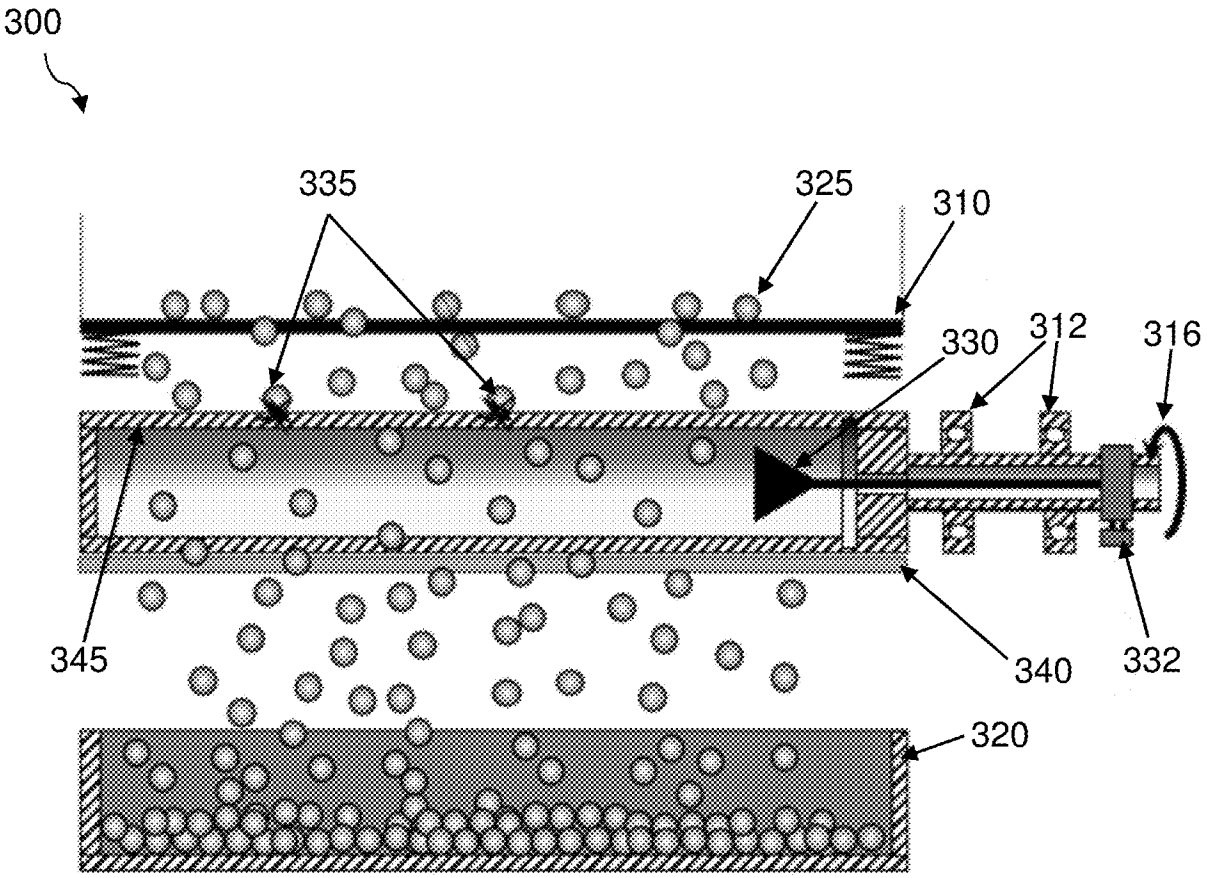
FIG. 3 is an illustration of a diagram of an example shaker system.

FIG. 3 is an illustration of a diagram of an example shaker system 300. Shaker system 300 demonstrates one embodiment of a system that can be used to collect acoustic data from a soundboard during drilling operations. During drilling operations, debris from within the borehole is moved toward the surface. The debris can be moved at the surface in such a way as to separate the solid components from the fluid components. The solid components can be moved to shaker system 300 where the solid components are dropped in from the top of shaker system 300. As the solid components, (e.g., cuttings, drill bit material or drill string material, a casing material, injected material, or other downhole material), drops through shaker system 300, the solid components will strike the soundboard creating acoustic waves that can be collected as acoustic data. The solid components would continue to fall into the cuttings box. The acoustic data can be analyzed to determine characteristics or parameters of the solid components. Injected material, e.g., tags, can be injected into a downhole stream, such as markers, which when returned to the surface, can be analyzed for changes due to downhole conditions.

Shaker system 300 demonstrates a shaker 310 which first receives solid components 325 at shaker system 300. Solid components 325 fall through shaker 310 and strike a soundboard 345 generating acoustic waves to be captured as acoustic data, as shown by cuttings 335 striking soundboard 345. The acoustic waves can be captured by microphone 330, which can be communicatively attached to an acoustic data analyzer or acoustic data processor, or another system.

Soundboard 345 can be rotated on bearing supports 312 using rotation indicated by arrow 316 (e.g., axially motion). In some aspects, soundboard 345 does not need to be rotated, rotation is shown for demonstration of a particular embodiment. For example, soundboard 345 can be rotated every few minutes, such as five minutes to present a clean surface for further solid components to strike. The rotation can be shorter than five minutes or longer than five minutes depending on the conditions and type of solid components striking soundboard 345.

Microphone 330 can be stabilized during the rotation of soundboard 345 using stabilization device 332 (e.g., slip rings). A scraper 340 can be used to periodically clean soundboard 345 of solid components 325, where solid components 325 fall into shaker container 320 (e.g., a cuttings box). In some aspects, scraper 340 is optional and is not needed to operate the system, such as where other cleaning methods are employed, such as rotating soundboard 345.

In some aspects, microphone 330 can be replaced with one or more other acoustic devices. For example, one or more of accelerometers, velocimeters, strain gauges, distributed acoustic sensors (DAS), optical DAS, optical time domain reflectometer (OTDR), electrical OTDR, semi-distributed sensors, vibrometers, seismometers, or other motion or momentum sensing devices can be used. In some aspects, more than one microphone 330 can be utilized within shaker system 300. Multiple microphones can be utilized to capture acoustic waves at different points of soundboard 345 thereby improving the data capture and being able to identify where along soundboard 345 a particular piece of solid component struck soundboard 345.

Figure 4:
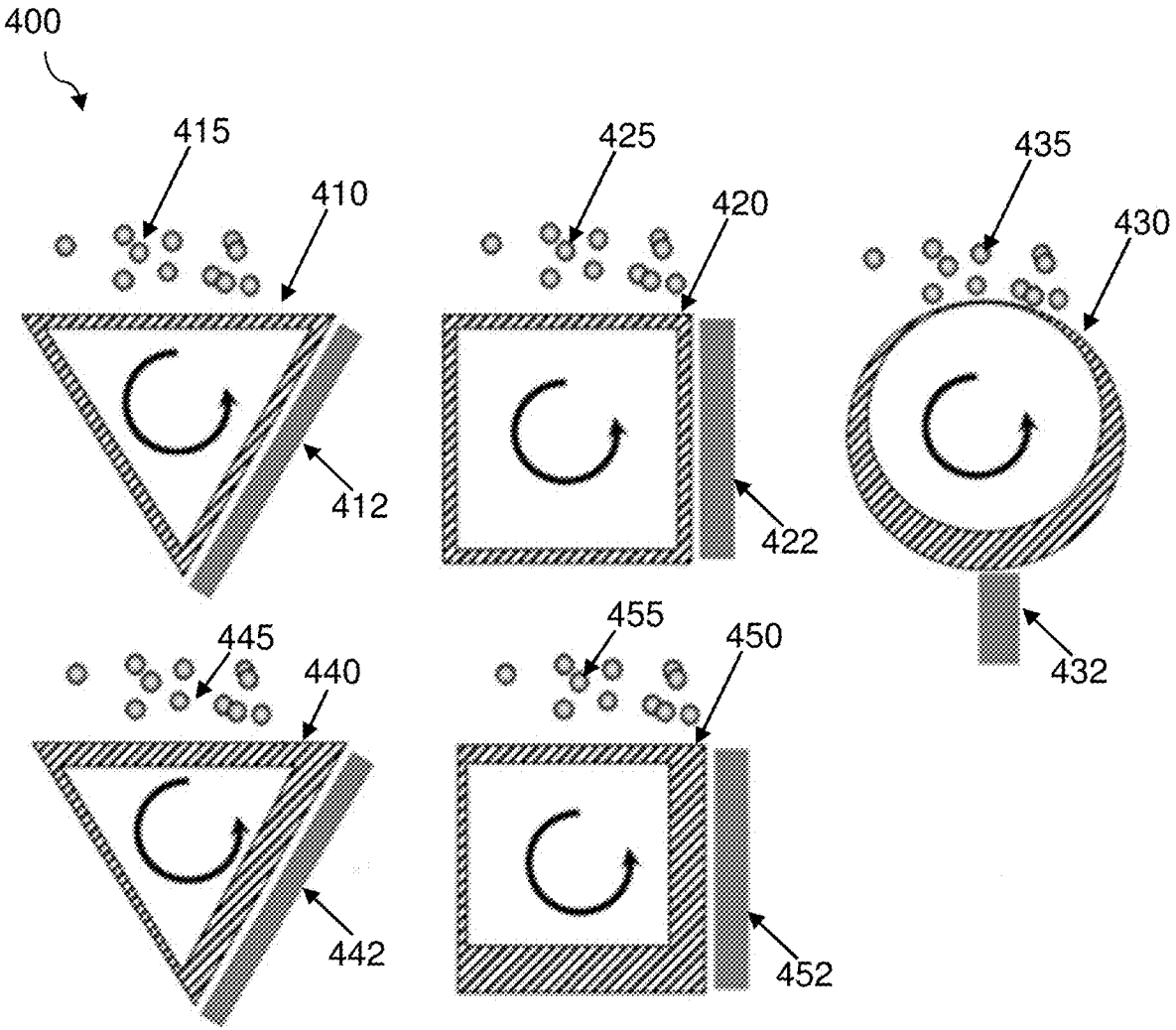
FIG. 4 is an illustration of diagrams of example soundboard cross sections that can be used in the shaker system of FIG. 3.

FIG. 4 is an illustration of diagrams of example soundboard cross sections 400 that can be used in shaker system 300. Soundboard 410 is a triangle shape and can rotate, for example, as indicated by the arrow. Solid components 415 can fall onto soundboard 410 to generate the acoustic waves, captured as acoustic data. Scraper 412 can be axially mounted to be able to move as soundboard 410 rotates. Soundboard 420 is a square shape and can rotate, for example, as indicated by the arrow. Solid components 425 can fall onto soundboard 420 to generate the acoustic waves, captured as acoustic data. Scraper 422 can be axially mounted to be able to move as soundboard 420 rotates. Soundboard 430 is a circle shape and can rotate, for example, as indicated by the arrow. Solid components 435 can fall onto soundboard 430 to generate the acoustic waves, captured as acoustic data. Scraper 432 can be fixed mounted to be able to scrape solid components 435 as soundboard 430 rotates.

Soundboard 440 is a triangle shape and can rotate, for example, as indicated by the arrow. Soundboard 440 utilizes different thicknesses for each side to provide varied acoustic generation. Solid components 445 can fall onto soundboard 440 to generate the acoustic waves, captured as acoustic data. Scraper 442 can be axially mounted to be able to move as soundboard 440 rotates. Soundboard 450 is a square shape and can rotate, for example, as indicated by the arrow. Soundboard 450 utilizes different thicknesses for each side to provide varied acoustic generation. Solid components 455 can fall onto soundboard 450 to generate the acoustic waves, captured as acoustic data. Scraper 452 can be axially mounted to be able to move as soundboard 450 rotates.

In some aspects, a soundboard can consist of more than one section, where each section can utilize a different configuration or shape than a neighboring section. In some aspects, different shaped soundboards can be utilized, for example, a trapezoid shape, a hexagon shape, a pentagon shape, or various other shape types whether symmetrical or asymmetrical. In some aspects, the natural frequency of the soundboard can be adjusted by the size and thickness of the material used in constructing the soundboard. This can improve the analysis by matching a soundboard type and size to the typical types of solid components striking the soundboard, enabling better data capture of the acoustic waves.

In some aspects, sound dampers can be used on or around the various soundboards to alter the acoustic collection parameters, for example, wood material, rubber material, plastic material, foam material, or other damper materials can be used. The soundboard damping factor can be controlled by using one or more of the various damping materials, for example, internally bonded to the soundboard. In some aspects, an internal space of the soundboard can be filled with a liquid, for example, a water, a brine, or an oil, to adjust the soundboard damping factor. In some aspects, the piping used or material used for the shaker, soundboard, scraper, or cuttings box can vary to allow different types of sound damping to occur. For example, a soundboard can be composed of a metal, a foam, a rubber, a plastic, a polyvinyl carbonate, a wood, other material, or a combination of materials.

Figure 5:
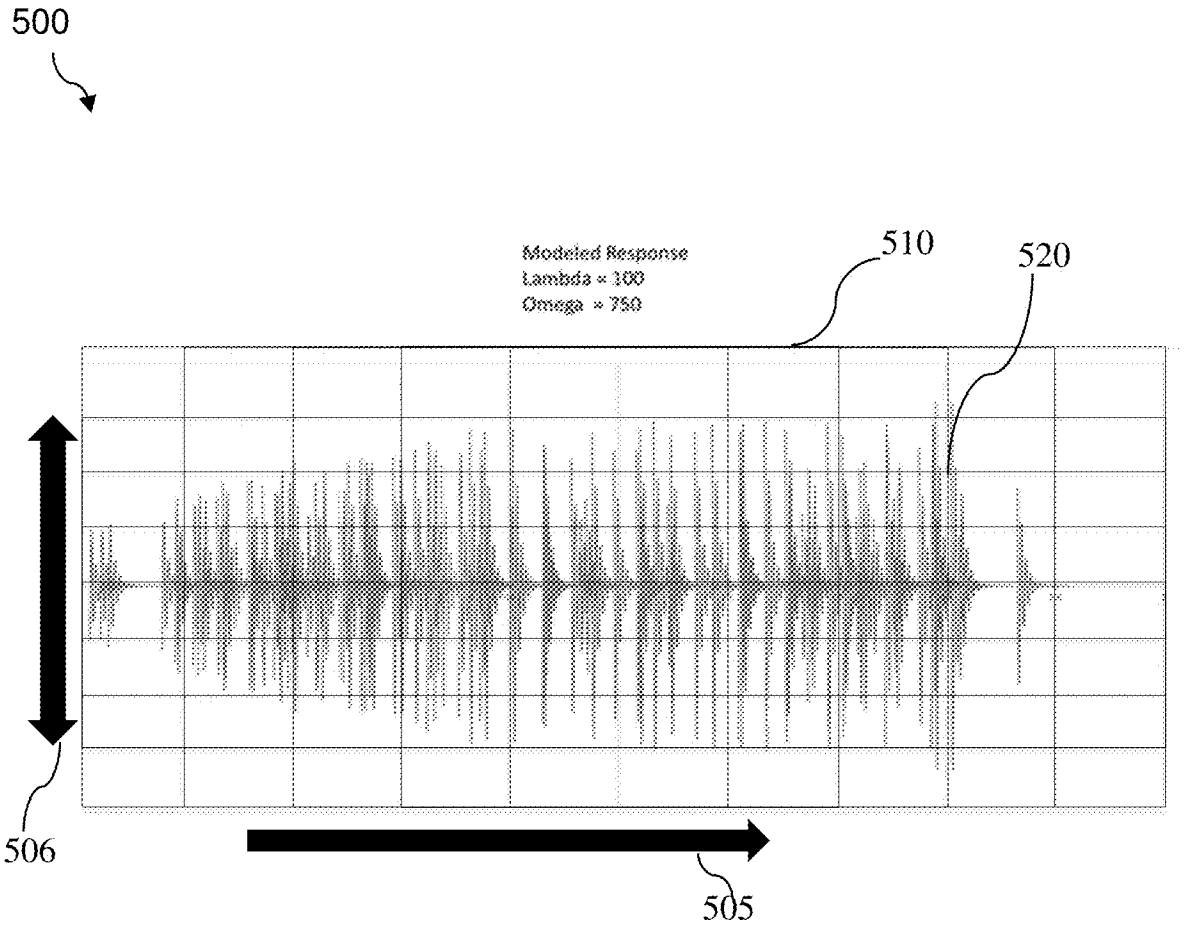
FIG. 5 is an illustration of a graph of an example acoustic data.

FIG. 5 is an illustration of a graph of an example acoustic data 500 as captured by, for example, shaker system 300. Acoustic data 500 represents the magnitude (i.e., amplitude) of the sound captured over a time interval. In this example, a damped free vibration analysis was applied for each discrete pair of amplitude A and time t data points. Amplitude A can be an indication of the mass of the solid component and of how far the solid component fell before hitting the soundboard. The discrete signatures were collected into acoustic data 500 to compare the measured signature. Equation 1 can be used as the damped free vibration equation to determine the frequency omega $\omega$, and the damping factor lambda k.

Equation 1: Example Damped Free Vibration Calculation for an Amplitude/Time Pair $$y(t)=A\times e^{-\lambda t}\times \mathrm{COS}(\omega t)$$

Acoustic data 500 has an x-axis 505 showing the increase in time as the data is captured. A y-axis 506 shows the relative amplitude of each data point that was captured. Plot area 510 shows the plotted pair of amplitude and time over the time interval. Data 520 can be analyzed to determine the various parameters of the solid components. The damping factor λ is 100 in this example and the frequency ω is 750. Data 520 can be superimposed on model or sample data to assist in determining a model fit to the captured acoustic data.

Figure 6:
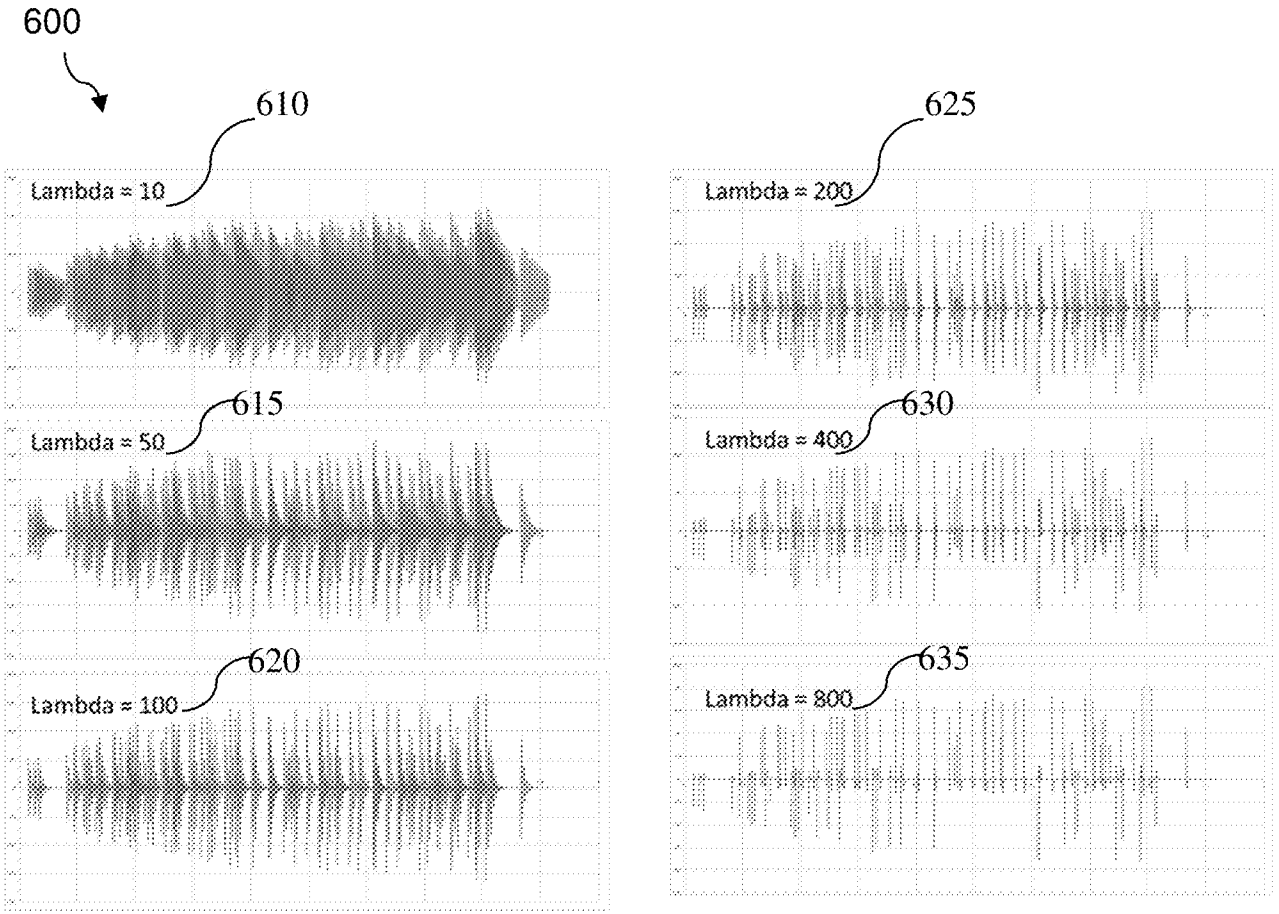
FIG. 6 is an illustration of a set of graphs showing an example acoustic data when the frequency is held at a constant of 750.

FIG. 6 is an illustration of a set of graphs showing an example acoustic data 600 when the frequency ω is held at a constant 750. Graph 610 demonstrates what the data would represent when the damping factor λ is 10. Graph 615 demonstrates what the data would represent when the damping factor λ is 50. Graph 620 demonstrates what the data would represent when the damping factor λ is 100. Graph 625 demonstrates what the data would represent when the damping factor λ is 200. Graph 630 demonstrates what the data would represent when the damping factor λ, is 400. Graph 635 demonstrates what the data would represent when the damping factor λ is 800.

Figure 7:
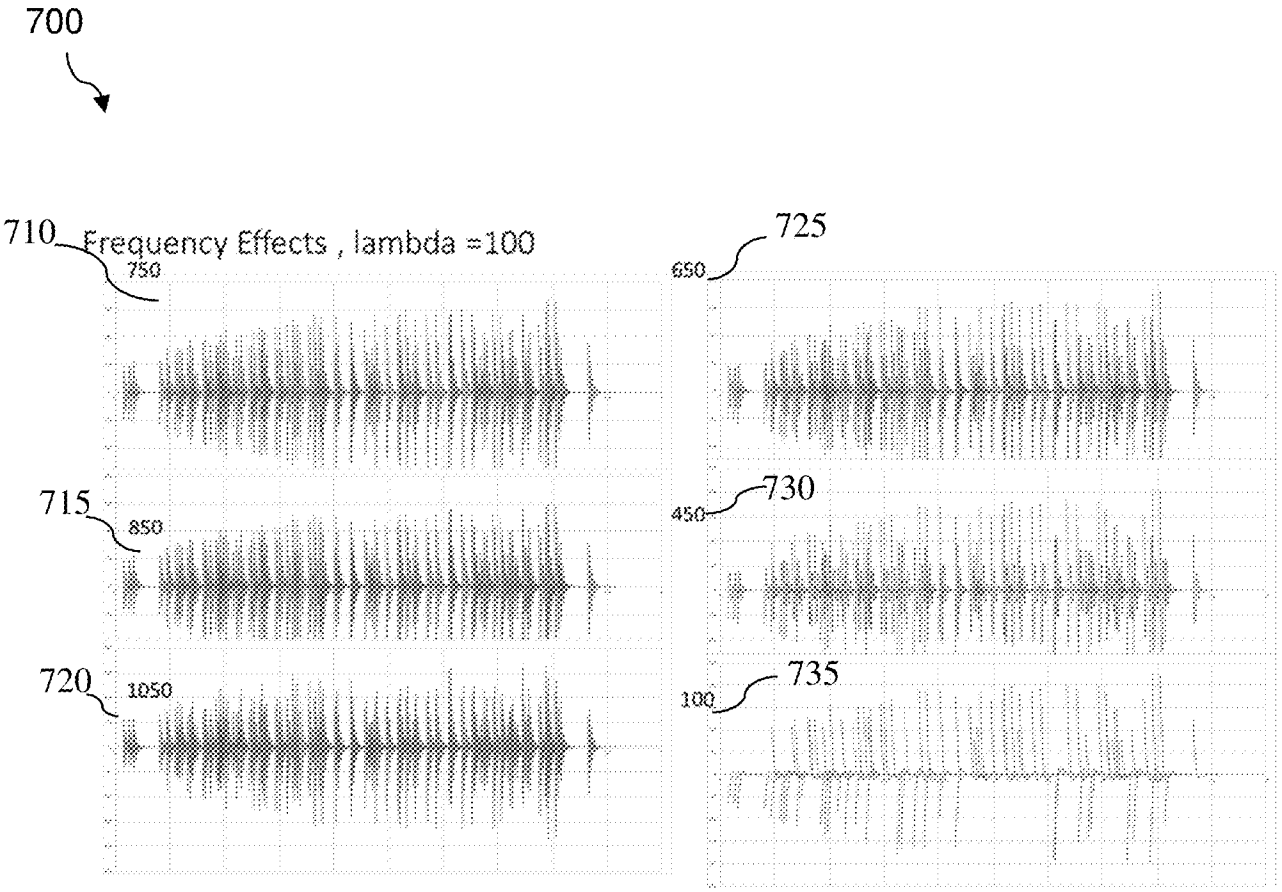
FIG. 7 is an illustration of a set of graphs showing an example acoustic data when the damping factor is held at a constant of 100.

FIG. 7 is an illustration of a set of graphs showing an example acoustic data 700 when the damping factor λ is held at a constant 100. Graph 710 demonstrates what the data would represent when the frequency ω is 750. Graph 715 demonstrates what the data would represent when the frequency ω is 850. Graph 720 demonstrates what the data would represent when the frequency ω is 1050. Graph 725 demonstrates what the data would represent when the frequency ω is 650. Graph 730 demonstrates what the data would represent when the frequency ω is 1450. Graph 735 demonstrates what the data would represent when the frequency ω is 100.

FIGS. 5, 6, and 7 demonstrate a visual graph of acoustic data. In some aspects, a visual component is not used and the implementation can analyze the collected acoustic data as data within a computing system, such as using a database or other data store. A graph or visual component is not needed.

Figure 8:
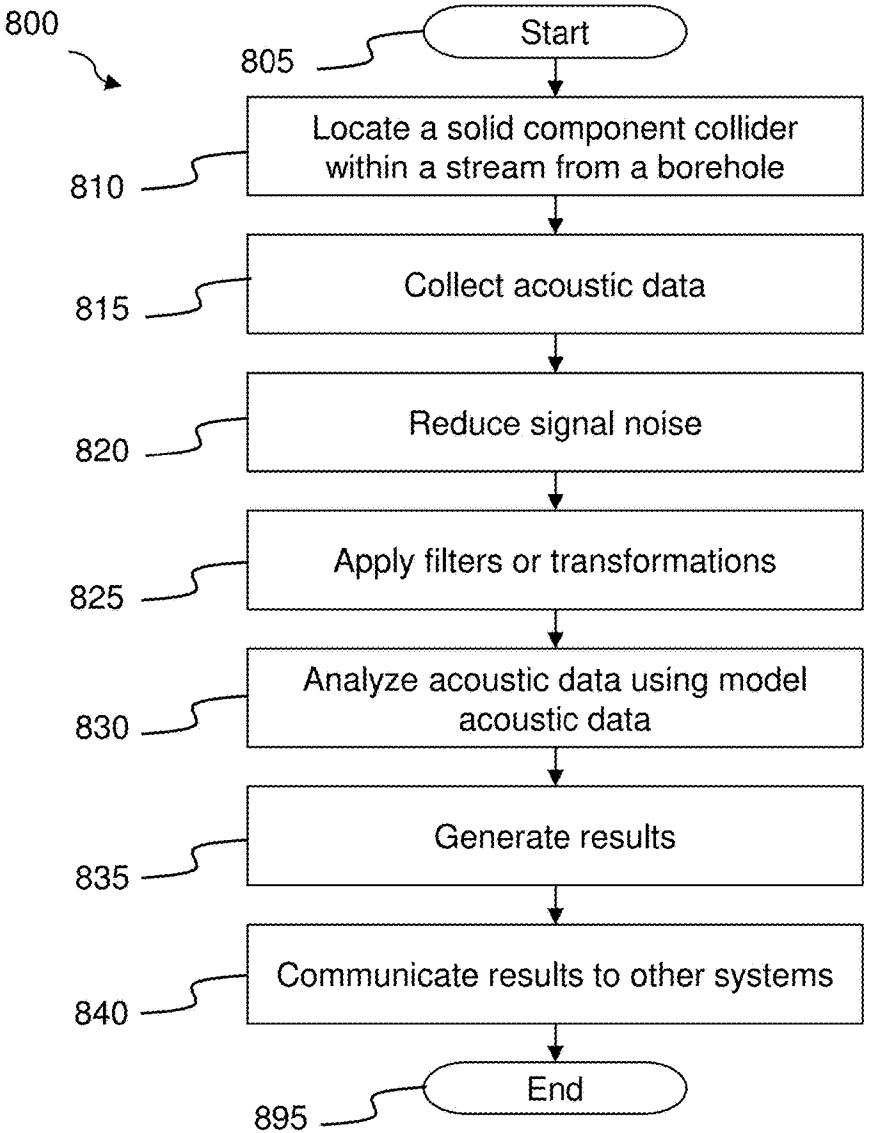
FIG. 8 is an illustration of a flow diagram of an example method 800 to demonstrate acoustic data analyzation of solid components in a borehole flow stream.

FIG. 8 is an illustration of a flow diagram of an example method 800 to demonstrate acoustic data analyzation of solid components in a borehole flow stream. Method 800 can be performed on a computing system, for example, acoustic data analyzer system 900 of FIG. 9 or acoustic data analyzer controller 1000 of FIG. 10. The computing system can be a well site controller, a geo-steering system, a reservoir controller, a data center, a cloud environment, a server, a laptop, a mobile device, smartphone, PDA, or other computing system capable of receiving the acoustic data, input parameters, and capable of communicating with other computing systems. Method 800 can be encapsulated in software code or in hardware, for example, an application, code library, dynamic link library, module, function, RAM, ROM, and other software and hardware implementations. The software can be stored in a file, database, or other computing system storage mechanism. Method 800 can be partially implemented in software and partially in hardware. Method 800 can perform the steps for the described processes, for example, determining the size, softness, or composition of solid components flowing through the output of a borehole operation.

Method 800 starts at a step 805 and proceeds to a step 810. In step 810, a solid component collider system can be located within a flow stream from a borehole. As fluid is pumped or moved from within a borehole to the surface, the fluid can pass through one or more different tools or systems. In some aspects, a bar or disc can be the solid component collider, such as being inserted into the piping of the return line from the borehole. In some aspects, the solid components can be separated from the fluid and moved through a shaker system, such as shaker system 300, where the solid component collider can be a soundboard.

In a step 815, acoustic data can be collected as the solid components in the flow stream collide with the bar, disc, or soundboard. The acoustic data can be collected using various tools, such as one or more microphones, transducers, or other acoustic devices. In a step 820, signal noise can be removed from the collected acoustic data. For example, the rig and equipment can generate vibrations that can impact the frequencies or amplitude. Prior to collecting acoustic data from the fluid stream, the baseline or model of the acoustic noise can be captured and modeled to provide a calibration of the acoustic data captured to more easily allow the removal of such noise from the collected acoustic data caused by the solid components.

In a step 825, one or more filters or transformations can be applied to the acoustic data to enable the subsequent analysis steps to process the data more easily. For example, a fast Fourier transformation (FFT) can be applied to improve the ability to extract parameters such as frequency sampling, block length, bandwidth, measurement duration, frequency resolution, number of peaks, and other analysis parameters. Other statistical and fitting methods, such as principal component analysis, wavelet analysis, Hilbert transform analysis, Monte Carlo modeling, or physical models can be used to complement the filters and transformations. These methods can constrain the parameters and expand the extrapolation capabilities of the analysis conducted in future steps.

In a step 830, the analysis parameters can be used, in conjunction with the processed acoustic data from step 825, to determine the solid component parameters (e.g., cuttings parameters). For example, the size, shape, mass, density, and softness, wettability, or other parameters can be determined. The size and mass can be determined using a dimensionality analysis to calculate the mass of the solid component as it hits the soundboard (or pipe). The amplitude of the acoustic data at the moment of impact is proportional to the energy of the solid component, thereby, together with the estimated density of the solid component from other sensors or data inputs, the size and mass can be approximated.

In some aspects, step 830 can be performed by a machine learning system (or other type of AI system). The machine learning system can apply the processed acoustic data to one or more acoustic data models to improve the determination of the various solid component parameters. For example, a model of quartz hitting a soundboard or a model of limestone striking a bar can be used to determine the parameters. In some aspects, the inputs into the analysis can be the known subterranean formation characteristics such as the type of rock or the estimated wettability (such as derived from other sensors downhole). Models can be developed from lab experiments, from acoustic data collected previously the current borehole, or from acoustic data collected at another borehole. The models can be shared with other systems at other boreholes. In some aspects, training of the models can include training the characteristics of the softness parameters, and other anomaly detection. For example, an analysis of the acoustic data can result in a determination that a potential caving event or stuck drill string event may occur, so that the users and systems can be alerted.

In a step 835, the one or more various parameters can be generated as a result. For example, using an output of a machine learning system to determine the solid component parameters. In a step 840, the results can be communicated to another system, such as a user, a well site controller, a drilling controller, or other system where the results can be used to adjust the drilling operation plan or the results can be used as input to corrective action. Method 800 ends at a step 895.

Figure 9:
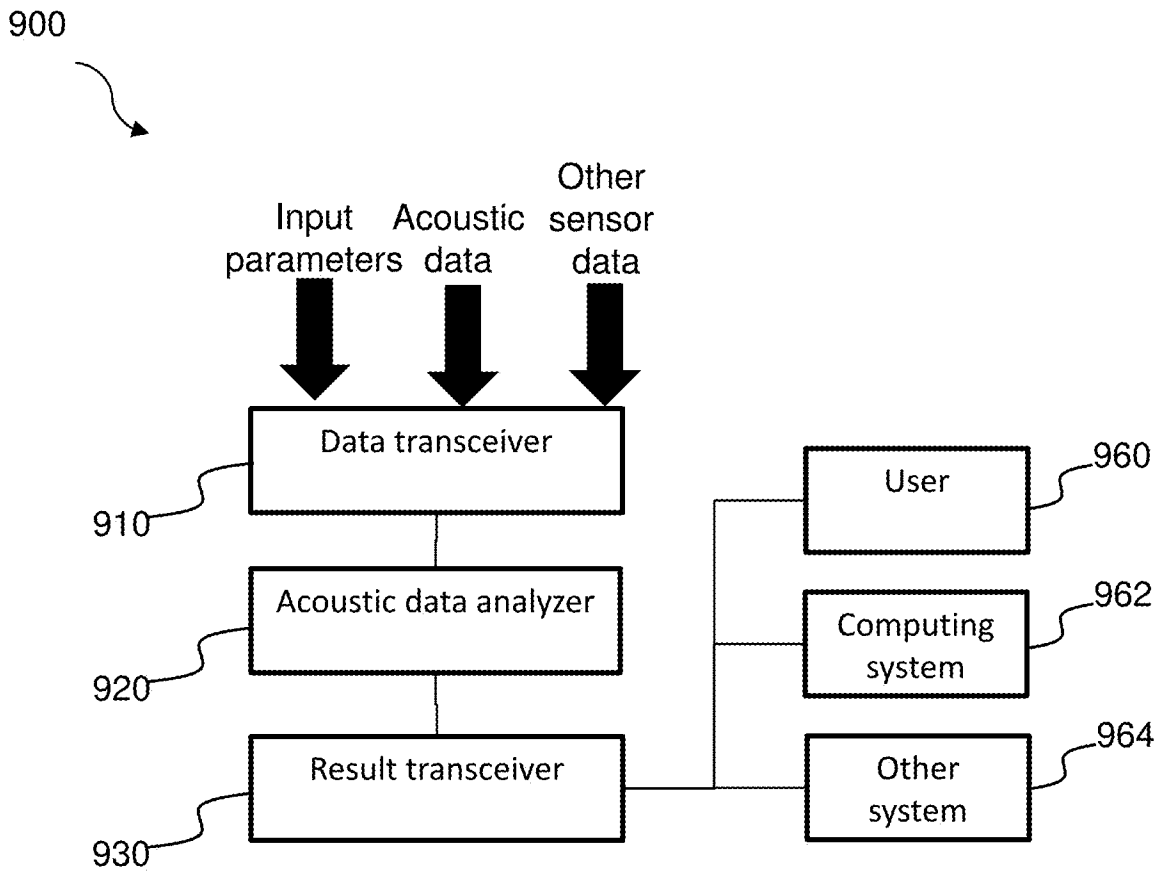
FIG. 9 is an illustration of a block diagram of an example acoustic data analyzer system.

FIG. 9 is an illustration of a block diagram of an example acoustic data analyzer system 900, which can be implemented in one or more computing systems, for example, a data center, cloud environment, server, laptop, smartphone, tablet, and other computing systems. In some aspects, acoustic data analyzer system 900 can be implemented using an acoustic data analyzer controller such as acoustic data analyzer controller 1000 of FIG. 9. Acoustic data analyzer system 900 can implement one or more methods of this disclosure, such as method 800 of FIG. 8.

Acoustic data analyzer system 900, or a portion thereof, can be implemented as an application, a code library, a dynamic link library, a function, a module, other software implementation, or combinations thereof. In some aspects, acoustic data analyzer system 900 can be implemented in hardware, such as a ROM, a graphics processing unit, or other hardware implementation. In some aspects, acoustic data analyzer system 900 can be implemented partially as a software application and partially as a hardware implementation. Acoustic data analyzer system 900 is a functional view of the disclosed processes and an implementation can combine or separate the described functions in one or more software or hardware systems.

Acoustic data analyzer system 900 includes a data transceiver 910, an acoustic data analyzer 920, and a result transceiver 930. The results, e.g., the parameters of the solid components (e.g., cuttings, drill bit filings, casing shavings, tags, or other solids), analysis, and interim outputs from acoustic data analyzer 920 can be communicated to a data receiver, such as one or more of a user or user system 960, a computing system 962, or other processing or storage systems 964. The results can be used to determine the directions provided to a drilling system or used as inputs into a well site controller or other borehole system, such as a drilling operation planning system.

Data transceiver 910 can receive input parameters, such as parameters to direct the operation of the analysis implemented by acoustic data analyzer 920, such as algorithms to utilize in determining the results, which transformations or filters to apply, estimated characteristics of the subterranean formation (e.g., type of rock), or other input parameters. In some aspects, data transceiver 910 can be part of acoustic data analyzer 920.

Result transceiver 930 can communicate one or more results, analysis, or interim outputs, to one or more data receivers, such as user or user system 960, computing system 962, storage system 964, e.g., a data store or database, or other related systems, whether located proximate result transceiver 930 or distant from result transceiver 930. Data transceiver 910, acoustic data analyzer 920, and result transceiver 930 can be, or can include, conventional interfaces configured for transmitting and receiving data. In some aspects, acoustic data analyzer 920 can be a machine learning system, such as to apply learned acoustic models to the collected acoustic data to improve the determination of the solid component parameters.

Acoustic data analyzer 920 (e.g., an acoustic processor such as processor 1030 of FIG. 10) can implement the analysis and algorithms as described herein utilizing the acoustic data, the input parameters, and other collected measurements. For example, acoustic data analyzer 920 can reduce the noise of the acoustic data, apply a transformation algorithm, and then process the acoustic data through a machine learning system to determine the result parameters.

A memory or data storage of acoustic data analyzer 920 can be configured to store the processes and algorithms for directing the operation of acoustic data analyzer 920. Acoustic data analyzer 920 can also include a processor that is configured to operate according to the analysis operations and algorithms disclosed herein, and an interface to communicate (transmit and receive) data.

Figure 10:
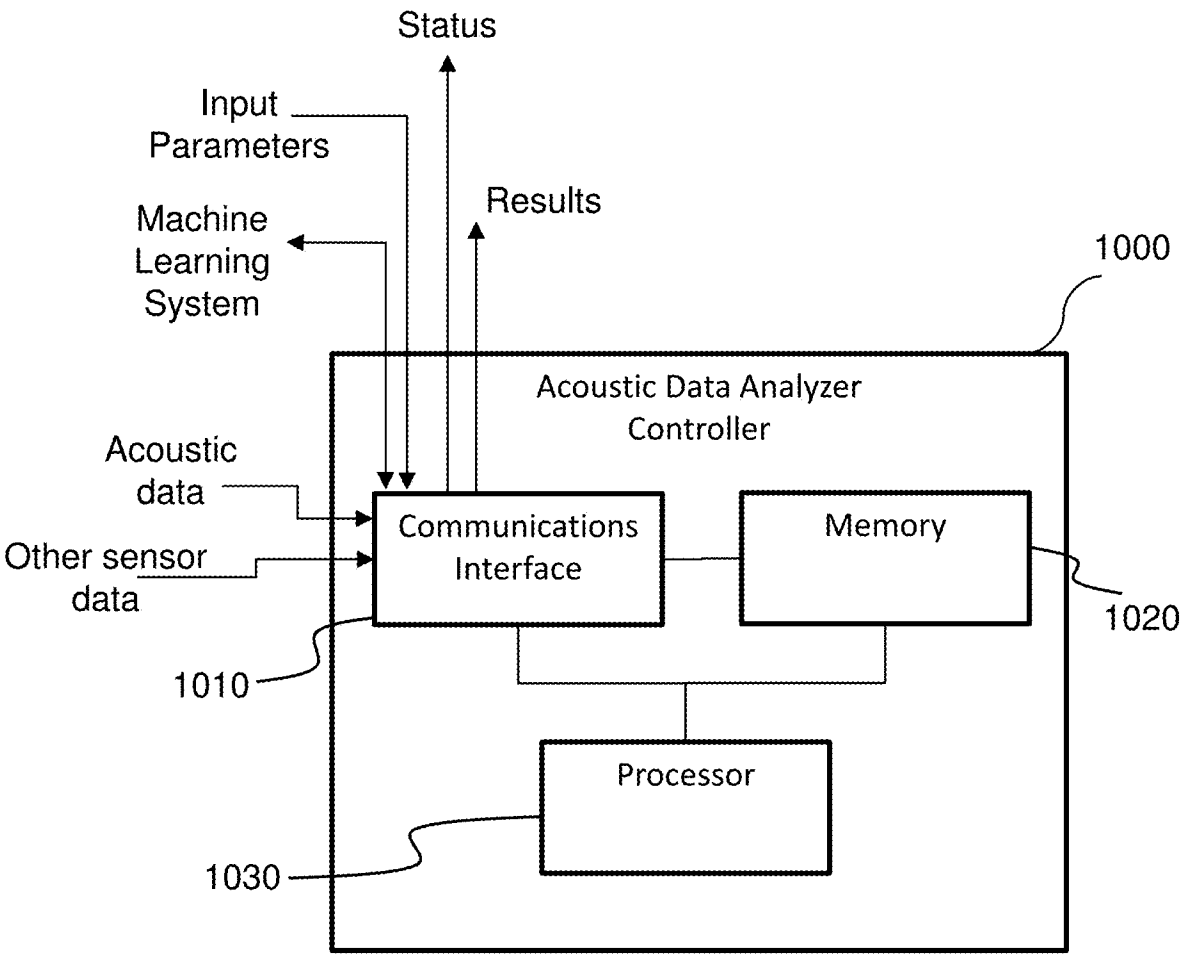
FIG. 10 is an illustration of a block diagram of an example of an acoustic data analyzer controller according to the principles of the disclosure.

FIG. 10 is an illustration of a block diagram of an example of an acoustic data analyzer controller 1000 according to the principles of the disclosure. Acoustic data analyzer controller 1000 can be stored on a single computer or on multiple computers. The various components of acoustic data analyzer controller 1000 can communicate via wireless or wired conventional connections. A portion or a whole of acoustic data analyzer controller 1000 can be located at one or more locations and other portions of acoustic data analyzer controller 1000 can be located on a computing device or devices located at a surface location. In some aspects, acoustic data analyzer controller 1000 can be wholly located at a surface or distant location. In some aspects, acoustic data analyzer controller 1000 can be part of another system, and can be integrated in a single device, such as a part of a drilling operation planning system, a well site controller, or other borehole system.

Acoustic data analyzer controller 1000 can be configured to perform the various functions disclosed herein including receiving input parameters, acoustic data, and other sensor measurements, and generating results from an execution of the methods and processes described herein, such as determining solid component parameters, and other results and analysis. Acoustic data analyzer controller 1000 includes a communications interface 1010, a memory 1020, and a processor 1030.

Communications interface 1010 is configured to transmit and receive data. For example, communications interface 1010 can receive the input parameters, acoustic data, and other collected sensor measurements. Communications interface 1010 can transmit the results, data from the input files, or interim outputs. In some aspects, communications interface 1010 can transmit a status, such as a success or failure indicator of acoustic data analyzer controller 1000 regarding receiving the various inputs, transmitting the generated results, or producing the results.

In some aspects, communications interface 1010 can receive input parameters from a machine learning system, for example, where the acoustic data is processed using one or more filters and algorithms and the machine learning system uses prior learned acoustic models to improve the determination of the solid component parameters.

In some aspects, the machine learning system can be implemented by processor 1030 and perform the operations as described by acoustic data analyzer 920. Communications interface 1010 can communicate via communication systems used in the industry. For example, wireless or wired protocols can be used. Communication interface 1010 is capable of performing the operations as described for data transceiver 910 and result transceiver 930 of FIG. 9.

Memory 1020 can be configured to store a series of operating instructions that direct the operation of processor 1030 when initiated, including the code representing the algorithms for determining processing the collected data. Memory 1020 is a non-transitory computer readable medium. Multiple types of memory can be used for data storage and memory 1020 can be distributed.

Processor 1030 can be configured to produce the results (e.g., determining the solid component parameters, and other results), one or more interim outputs, and statuses utilizing the received inputs. Processor 1030 can be configured to direct the operation of acoustic data analyzer controller 1000. Processor 1030 includes the logic to communicate with communications interface 1010 and memory 1020, and perform the functions described herein. Processor 1030 is capable of performing or directing the operations as described by acoustic data analyzer 920 of FIG. 9.

Various figures and descriptions can demonstrate a visual display of the acoustic data and the resulting analysis of the acoustic data. In some aspects, the visual display can be utilized by a user to determine the next steps of the analysis. In some aspects, the visual display does not need to be generated, and a system, such as a machine learning system, can perform the analysis using the received data. In some aspects, a visual display and a machine learning system can be utilized. In some aspects, the acoustic data or partially analyzed acoustic data can be transmitted to one or more surface computing systems, such as a well site controller, a computing system, or other processing system. The surface system or surface systems can perform the analysis and can communicate the results to one or more other systems, such as a well site controller, a well site operation planner, a geo-steering system, or another borehole system.

A portion of the above-described apparatus, systems or methods may be embodied in or performed by various analog or digital data processors, wherein the processors are programmed or store executable programs of sequences of software instructions to perform one or more of the steps of the methods. A processor may be, for example, a programmable logic device such as a programmable array logic (PAL), a generic array logic (GAL), a field programmable gate arrays (FPGA), or another type of computer processing device (CPD). The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computers to perform one, multiple or all of the steps of one or more of the above-described methods, or functions, systems or apparatuses described herein.

Portions of disclosed examples or embodiments may relate to computer storage products with a non-transitory computer-readable medium that have program code thereon for performing various computer-implemented operations that embody a part of an apparatus, device or carry out the steps of a method set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floppy disks; and hardware devices that are specially configured to store and execute program code, such as ROM and RAM devices. Examples of program code include both machine code, such as produced by a compiler, and files containing higher level code that may be executed by the computer using an interpreter. Configured or configured to means, for example, designed, constructed, or programmed, with the necessary logic and/or features for performing a task or tasks.

In interpreting the disclosure, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced.

Those skilled in the art to which this application relates will appreciate that other and further additions, deletions, substitutions and modifications may be made to the described embodiments. It is also to be understood that the terminology used herein is for the purpose of describing particular embodiments only, and is not intended to be limiting, since the scope of the present disclosure will be limited only by the claims. Unless defined otherwise, all technical and scientific terms used herein have the same meaning as commonly understood by one of ordinary skill in the art to which this disclosure belongs. Although any methods and materials similar or equivalent to those described herein can also be used in the practice or testing of the present disclosure, a limited number of the exemplary methods and materials are described herein.

Each of the aspects disclosed in the SUMMARY can have one or more of the following additional elements in combination. Element 1: wherein the soundboard is a shape of one of a triangle shape, a square shape, a circle shape, a trapezoid shape, a pentagon shape, or a hexagon shape. Element 2: wherein the soundboard is a different thickness on each side of the soundboard. Element 3: wherein the soundboard is configured to rotate axially. Element 4: a shaker container configured to hold the solid components after striking the soundboard. Element 5: wherein the soundboard comprises more than one section and each section is a different shape or a different thickness. Element 6: a scraper, configured to scrape the solid components off of the soundboard. Element 7: wherein the scraper is fixed in position. Element 8: wherein the scraper is configured to move in an axial motion around the soundboard. Element 9: wherein the acoustic device is at least one of one or more microphones, one or more accelerometers, one or more velocimeters, one or more strain gauges, one or more distributed acoustic sensors, one or more optical time domain reflectometers, one or more vibrometers, or one or more seismometers. Element 10: a sound damper, configured to dampen the acoustic waves, wherein the sound damper is attached to the soundboard. Element 11: wherein the soundboard has an internal space, and the internal space is filled with a dampening fluid, where the dampening fluid is configured to dampen the acoustic waves. Element 12: a result transceiver, capable of communicating the one or more solid component parameters to a borehole system. Element 13: wherein the acoustic device is a set of acoustic devices, and each acoustic device in the set of acoustic devices is located at a different position relative to the solid component collider. Element 14: wherein the solid component collider is a bar or a disc located within the return flow line. Element 15: wherein the solid component collider is a soundboard located within a shaker system. Element 16: wherein the acoustic device is attached to the solid component collider. Element 17: wherein the acoustic processor utilizes a machine learning system to compare the acoustic data to acoustic models stored in the machine learning system. Element 18: calibrating the location acoustic model to correct for surface equipment noise or equipment vibration. Element 19: wherein the analyzing is performed by a machine learning system. Element 20: wherein tags are injected into a downhole fluid stream and the solid components are the tags, and the solid component parameter includes a fluid transport efficiency parameter or a drilled solids sag. Element 21: wherein the results include an interaction strength parameter of cuttings with a subterranean formation, where the interaction strength parameter is one of a chemical attraction, a magnetic attraction, or an electric attraction. Element 22: wherein the solid component collider is a soundboard, and a size or a thickness of the soundboard is modified to alter a natural frequency of the soundboard.

What is claimed is:

1. An apparatus, comprising:

a shaker, configured to receive solid components from a return flow line of a borehole undergoing a drilling operation, and configured to restrict a flow of solid components;

a soundboard, configured to be struck by the solid components falling from the shaker; and an acoustic device, configured to capture acoustic waves generated by the solid components striking the soundboard, and configured to communicate the acoustic waves to an acoustic data processor as acoustic data, and wherein the acoustic data processor is configured to determine one or more parameters of the solid components using the acoustic data.

2. The apparatus as recited in claim 1, wherein a cross section of the soundboard is a shape of one of a triangle shape, a square shape, a circle shape, a trapezoid shape, a pentagon shape, or a hexagon shape.

3. The apparatus as recited in claim 2, wherein the soundboard is a different thickness on each side of the soundboard.

4. The apparatus as recited in claim 1, wherein the soundboard is configured to rotate axially.

5. The apparatus as recited in claim 1, further comprising:

a shaker container, configured to hold the solid components after striking the soundboard.

6. The apparatus as recited in claim 1, wherein a cross section of the soundboard comprises more than one section and each section is a different shape or a different thickness.

7. The apparatus as recited in claim 1, further comprising:

a scraper, configured to scrape the solid components off of the soundboard.

8. The apparatus as recited in claim 7, wherein the scraper is fixed in position.

9. The apparatus as recited in claim 7, wherein the scraper is configured to move in an axial motion around the soundboard.

10. The apparatus as recited in claim 1, wherein the acoustic device is at least one of one or more microphones, one or more accelerometers, one or more velocimeters, one or more strain gauges, one or more distributed acoustic sensors, one or more optical time domain reflectometers, one or more vibrometers, or one or more seismometers.

11. The apparatus as recited in claim 1, further comprising:

a sound damper, configured to dampen the acoustic waves, wherein the sound damper is attached to the soundboard.

12. The apparatus as recited in claim 1, wherein the soundboard has an internal space, and the internal space is filled with a dampening fluid, where the dampening fluid is configured to dampen the acoustic waves.

13. A system, comprising:

a return flow line from a borehole containing a fluid and solid components, wherein the borehole is undergoing a drilling operation;

a solid component collider, capable of generating acoustic waves when struck by the solid components moving through the return flow line; wherein the solid component collider is a soundboard located within a shaker system;

an acoustic device, capable of collecting the acoustic waves and storing the acoustic waves as acoustic data; and an acoustic processor, capable of filtering, transforming, and analyzing the acoustic data to generate one or more solid component parameters.

14. The system as recited in claim 13, further comprising:

a result transceiver, capable of communicating the one or more solid component parameters to a borehole system.

15. The system as recited in claim 13, wherein the acoustic device is a set of acoustic devices, and each acoustic device in the set of acoustic devices is located at a different position relative to the solid component collider.

16. The system as recited in claim 13, wherein the acoustic device is attached to the solid component collider.

17. The system as recited in claim 13, wherein the acoustic processor utilizes a machine learning system to compare the acoustic data to acoustic models stored in the machine learning system.

18. A method, comprising:

collecting acoustic data, using an acoustic device, from acoustic waves generated by solid components striking a solid component collider located at a surface portion of a return flow line of a borehole undergoing a drilling operation, wherein the solid components are located in the return flow line; wherein the solid component collider is a soundboard located within a shaker system;

reducing signal noise in the acoustic data using a location acoustic model of the borehole and surface equipment;

applying one or more filters or transformations to the acoustic data to generate modified acoustic data; and analyzing the modified acoustic data using one or more previously trained models to generate results, wherein the results include a determination of at least one solid component parameter.

19. The method as recited in claim 18, further comprising:

calibrating the location acoustic model to correct for surface equipment noise or equipment vibration.

20. The method as recited in claim 18, wherein the analyzing is performed by a machine learning system.

21. The method as recited in claim 18, wherein tags are injected into a downhole fluid stream and the solid components are the tags, and the solid component parameter includes a fluid transport efficiency parameter or a drilled solids sag.

22. The method as recited in claim 18, wherein the results include an interaction strength parameter of cuttings with a subterranean formation, where the interaction strength parameter is one of a chemical attraction, a magnetic attraction, or an electric attraction.

23. The method as recited in claim 18, wherein a size or a thickness of the soundboard is modified to alter a natural frequency of the soundboard.

* * * * *